United States Patent [19]

Takano et al.

[11] 4,121,839

[45] Oct. 24, 1978

[54] SEALING SYSTEM FOR USE IN COMPOSITE MULTI-STAGE PUMP

[75] Inventors: Shiro Takano; Toshio Jojima, both of Tokyo; Hajime Oshida, Funabashi; Tadashi Yokoi, Chiba; Muneo Kato, Kitaminemachi; Tadashi Koizumi, Kawasaki, all of Japan

[73] Assignees: Mitsui Toatsu Chemicals, Inc.; Toyo Engineering Corporation; Ebara Corporation, all of Tokyo, Japan

[21] Appl. No.: 823,100

[22] Filed: Aug. 9, 1977

[30] Foreign Application Priority Data

| | | | |
|---|---|---|---|
| Aug. 18, 1976 | [JP] | Japan | 51-97670 |
| Aug. 18, 1976 | [JP] | Japan | 51-97671 |
| Aug. 18, 1976 | [JP] | Japan | 51-97672 |
| Aug. 27, 1976 | [JP] | Japan | 51-101541 |

[51] Int. Cl.[2] ..... F16J 15/40; F01D 11/02

[52] U.S. Cl. ..... 277/3; 277/12; 277/70; 277/226; 415/100; 415/112; 417/243; 417/244

[58] Field of Search ..... 277/3, 15, 12, 22, 27, 277/59, 226, 70, 71, 72 R, 72 FM, 74, 79; 415/110–113, 96, 100, 199.1, 199.2; 417/243, 244

[56] References Cited

U.S. PATENT DOCUMENTS

| | | | |
|---|---|---|---|
| 1,123,364 | 1/1915 | Peterson | 415/111 X |
| 1,151,965 | 8/1915 | Peterson | 277/12 X |
| 1,900,531 | 3/1933 | Vitu | 415/100 |
| 1,912,452 | 6/1933 | Hollander | 415/100 |
| 1,978,277 | 10/1934 | Noble | 415/100 |
| 3,297,329 | 1/1967 | Smith et al. | 277/3 |
| 3,420,434 | 1/1969 | Swearingen | 415/112 |
| 3,718,406 | 2/1973 | Onal | 415/111 |
| 3,792,935 | 2/1974 | Randell | 415/110 |

FOREIGN PATENT DOCUMENTS

| | | | |
|---|---|---|---|
| 880,763 | 9/1971 | Canada | 277/70 |
| 2,034,586 | 1/1972 | Fed. Rep. of Germany | 415/112 |
| 1,337,460 | 8/1963 | France | 415/112 |
| 286,623 | 1/1929 | United Kingdom | 415/110 |
| 549,922 | 12/1942 | United Kingdom | 415/100 |
| 1,393,955 | 5/1975 | United Kingdom | 415/111 |

*Primary Examiner*—Robert S. Ward, Jr.
*Attorney, Agent, or Firm*—Oblon, Fisher, Spivak, McClelland & Maier

[57] ABSTRACT

A sealing system for use in a composite multi-stage pump or pumps is disclosed which utilizes part of the liquid pressurized by the pump to moderate sealing conditions by introducing said liquid to a portion or portions around the shaft, where the sealing conditions are most critical, and by thus reducing the pressure imposed on the sealing portion make the designing of seals easy. Also, by introducing pressurized liquid of relatively low temperature to the critical portion(s), minimum flow rate is lowered and thus the operational range of the pump is extended.

When two or more pumps are employed for maintaining continuous operation by alternately switching the working pumps, a flow passage is provided between the pumps so the pressurized liquid from the pump under operation can be introduced to the non-operating pump, thus utilizing the pressurized liquid to prevent liquid kept under pressure in the non-operating pump from leaking therefrom.

9 Claims, 12 Drawing Figures

5
6 a
6 b
90°C
15K
92°C
75K
152.5°C
190K
150°C
70K
90°C
45K
92°C 75K
93.5°C
15K
92°C 75K
70K
152°C
150°C
130K
1a
1b
1c
1d
1e
1f
3a
3b
4a
4b
7
8
9
10
A
B 5
6 a
6 b
90°C
15K
97.5°C
75K
158.5°C
190K
150°C
70K
97.5°C
99°C
15K
150°C
130K
155.5°C
1a
1b
1c
1d
1e
1f
3a
3b
4a
4b
7
8
9
10

SEALING SYSTEM FOR USE IN COMPOSITE MULTI-STAGE PUMP

Field of Invention

This invention relates to a sealing system for a multi-stage pump and particularly to a system wherein an axial force acting on the shaft of the pump is minimized.

BACKGROUND OF INVENTION

It is customary to employ a pump to move and deliver liquid, and to vary the pressure thereof. If a higher pressure is required, two or more pumps are employed as required. Also, in almost all devices designed to handle liquid, leakage of the liquid from the devices is a problem in the design, operation and maintenance of such devices.

It is obviously more difficult to design such a device when the pressure and temperature of the liquid are high or the liquid is dangerous or harmful. In order to raise the pressure, one or more additional pumps may be installed. For example, in a pumping system handling chemical solution under high pressure and at high temperature, associated equipment such as a liquid or solution reservoir, absorption tower and/or reaction tank may be provided in double and two pumps will be employed so as to deliver the solution sequentially. If two pumps are employed, it is necessary to provide a shaft sealing mechanism at four places. Also, it is more difficult to seal the second pump effectively, due to the higher pressure and the higher temperature of the solution in the second pump. Should the solution be dangerous or harmful, failure in the seals would cause serious problems. Thus, those factors involved in the installation of plural pumps in series result in a substantial increase in the cost of the whole system.

One attempt to solve this problem is to combine the two pumps into a single unit comprising two pump sections and to transfer the solution outside once from the intermediate portion between the two sections to the second stage of the unit through the first reservoir, absorption tower or reaction tank thereby reducing the total number of sealing portions required to two. In such multi-stage pump, the axial thrust is usually balanced axially with respect to the whole unit. However, in such multi-stage pump, the balance of the axial thrust may not be maintained and the resulting thrust may become very large, if the operating conditions or the requirements in each of the both sections are varied.

It is also well known that a certain operational range for a minimum flow rate is usually specified for a certain pump and such range becomes narrower as the temperature and pressure of the liquid to be pumped become higher. In the operation of a pump at minimum flow rate, the temperature of the liquid passing the pump becomes relatively high compared to that under the operation of the pump at nominal or ordinary flow rate. This increases the possibility of failure at the sealing portions, which may result in leakage or evaporation of the liquid. Also, in the composite multi-stage pump including plural pump sections, the general tendency is that the temperature of the liquid or solution, especially if chemical reactions are involved, is raised as the liquid or solution is fed from the lower pressure side to the higher pressure side. Under such condition, should the liquid or solution of higher temperature be introduced to the side of lower pressure and the lower temperature, vaporization would occur within the pump section which might put the pump impeller in unoperable condition.

SUMMARY OF INVENTION

Accordingly, a sealing system for use in a multi-stage pump which is free from the above drawbacks has long been desired.

Thus, it is an object of this invention to provide a sealing system for use in a composite multi-stage pump or pumps wherein axial thrust imposed on the pump shaft is made minimum or zero.

It is a further object of this invention to provide a sealing system for which the design of mechanical seals is made simple and easy.

It is also an object of this invention to provide a sealing system in the multi-stage pump(s) as defined which is easy to maintain and insures safe operation without risk of leakage of the liquid passing through the pump or evaporation of the liquid within the pump.

It is also an object of the present invention to provide a sealing system applicable to plural composite pumps arranged to maintain the continuous operation.

It is also an object of this invention to provide a sealing system which effectively prevents the flow of high pressure and high temperature liquid to where it might cause vaporization within a pump section.

In accordance with the teaching of this invention, a novel sealing system particularly suitable for use in a composite multi-stage pump is provided wherein part of the pressurized liquid being moved by the pump is introduced into the portion or portions within the pump around the shaft where the sealing conditions are most critical so thereby moderating such conditions.

Other objects and advantages of this invention will become more clear when the description of the preferred embodiments hereunder is reviewed in conjunction with the accompanying drawings the brief explanation of which follows.

BRIEF DESCRIPTION OF DRAWINGS

The same reference numeral designates the same functional part throughout the accompanying drawings wherein.

DESCRIPTION OF PREFERRED EMBODIMENTS

Figure 1:
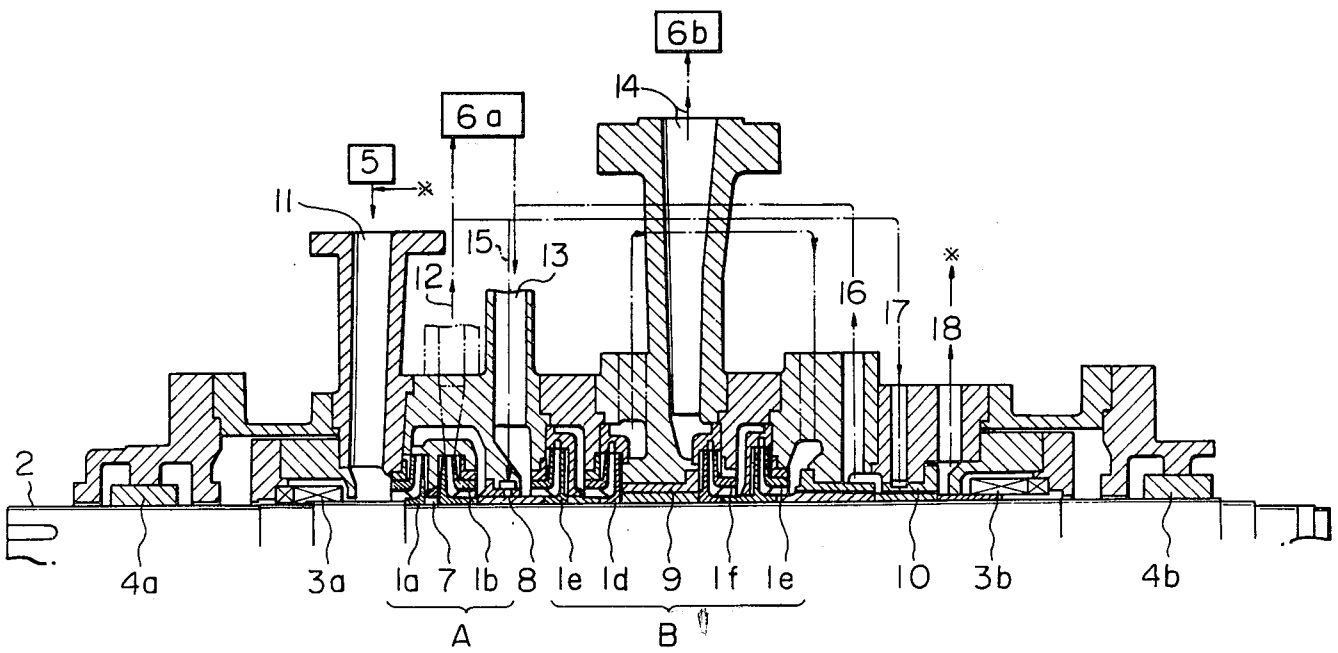
FIG. 1 is a partial sectional view of a composite multi-stage pump embodying the sealing system of this invention.

Referring to FIG. 1, a sectional view of a sealing system of a preferred embodiment of this invention is illustrated. In FIG. 1, for the parts or portions similar in function the same reference numeral is given followed by alphabetical suffixes in sequence from a low pressure stage to a higher pressure stage. This suffixing system will also be applied to the rest of the drawings. The system illustrated is mainly a pump construction of a composite multi-stage pump comprising a first or low pressure pump section "A" and a second or high pressure pump section "B". The first section "A" comprises two stages corresponding to portions where impellers 1*a* and 1*b* are securely mounted on a shaft 2 so as to be unitarily rotated therewith. The second section "B" comprises four stages corresponding to portions where impellers 1*c*, 1*d*, 1*e* and 1*f* are also securely mounted on the shaft 2. Thus, the pump illustrated is a six-stage pump comprising two low pressure stages and four high pressure stages. At the axially opposite sides of the pump, mechanical seals 3*a* and 3*b* are installed and, at the respective axially outer portions thereof, bearings 4*a* and 4*b* are provided so as to rotatably support the shaft 2.

A chemical solution reservoir 5 is schematically shown in FIG. 1 which supplies solution to the first pump section "A" through an inlet port 11 of the pump. The pressure of the solution sucked into the pump section "A" is raised by two stages of the section "A" and the solution is discharged through an outlet port 12 to a first reaction tank 6*a* which is schematically shown in FIG. 1 where the solution is chemically reacted and, also, the temperature thereof is raised depending on the working conditions, such as chemical conditions, imposed thereon.

The solution is further sucked through an inlet port 13 into the second pump section "B" where the pressure of the solution is further raised through four stages and such solution is discharged through an outlet port 14 into a second reaction tank 6*b* wherein chemical reaction is also effected.

The axial thrust imposed on the shaft due to the rotation of the impellers is usually balanced in the multistage pump as a whole unit; however, if the operational conditions are changed or different in the sections "A" and "B", a large thrust may be imposed on the shaft. Therefore, in the embodiment illustrated, the axial thrust is balanced independently in each of the sections "A" and "B" so that variation of operational conditions in either or both of the sections may not create axial thrust. To such end, as illustrated in FIG. 1, the impellers 1*a* and 1*b* of the pump section "A" are mounted on the shaft in opposing fashions to produce equal axial thrust in opposite directions and also, in the pump section "B", the impeller 1*c* and 1*d* are mounted on the shaft 2 in a manner or fashion opposite to that of the impellers 1*e* and 1*f*. By such arrangement of the impellers, the axial thrust is independently balanced within each of the pump sections "A" and "B" whereby variation in the operational conditions in either or both of the sections may not cause imbalance of the axial thrust or create a large axial thrust. A plurality of auxiliary sealing means is disposed on the shaft and they are illustrated in FIG. 1 as pressure reduction bushing 7, 8, 9 and 10.

The portion of the delivery solution discharged from an outlet port 12 of the pump section "A" is fed to the pressure reduction bushings 8 and 10 through flow passages 15 and 17, respectively. The pressure reduction bushing 8 is given a restricted axial flow passage in the axial direction between the bushing and shaft and an inlet opening at a place between the axially opposite ends thereof which communicates with both of the passage 15 and the restricted axial passage. Also the pressure reduction bushing 10 is given a restricted flow passage in the axial direction between the shaft and the bushing 10 and two openings at places about midway between the opposite ends of the bushing, one of them communicating with the flow passage 17 and the axial restricted passage and the other communicating with an outlet passage 18 as well as the axial restricted passage. The outlet passages 16 and 18 are coupled to the outlet port 12 and the inlet port 11, respectively.

Figure 2A:
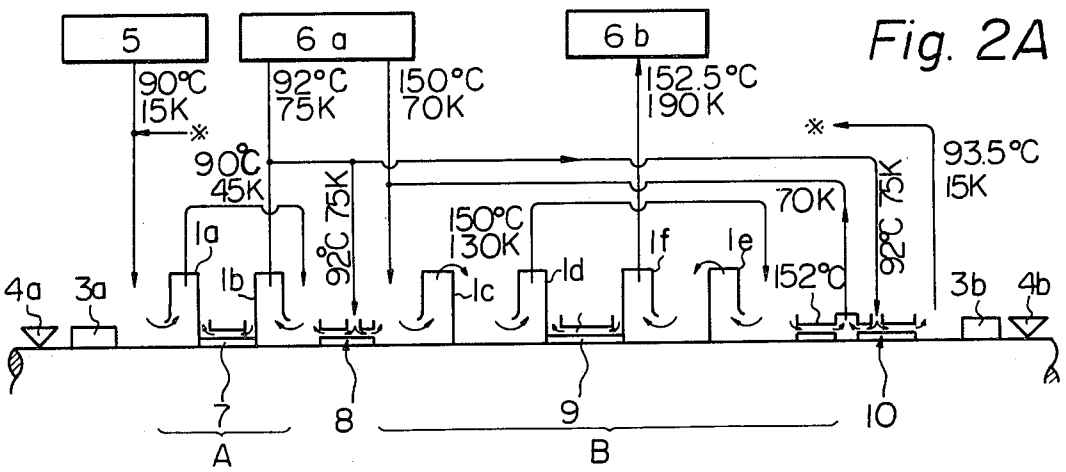
FIGS. 2A and 2B are schematic illustrations of the sealing system embodied in the pump shown in FIG. 1 wherein explanatory data regarding the temperature and pressure of liquid are added for the purpose of aiding understanding of the operation of the system, and "K" is used throughout the drawings to designate "kgf/cm$^2$g" which is the unit of gauge pressure of kg-force per unit area (cm$^2$)

FIG. 2A is a schematic illustration of the system corresponding to FIG. 1, and it includes some operational data explaining the examples of the pressure and temperature at various places. The numerical data are presented just for better understanding of the present invention and it should be noted that the values specified therein are not intended to limit the operation or the scope of the present invention in any way. According to the example of FIG. 1, a chemical solution 90° C. in temperature is contained in the reservoir 5 under pressure of 15 kgf/cm$^2$g. (Gauge pressure expressed by kilogram force per cm$^2$: This is applied throughout the specification.) The pressure of the solution is raised to 45 kgf/cm$^2$g by the first stage impeller 1a in the pump section "A" and this is further pressurized to 75 kgf/cm$^2$g by the impeller 1*b*. Then it is discharged with temperature of 92° C. to the first reaction tank 6*a* wherein the temperature of the solution is raised to 150° C. and its pressure becomes 70 kgf/cm$^2$g. The pressure of the solution is further raised to 130 kgf/cm$^2$g through the third and fourth stage impellers 1*c* and 1*d* and to 190 kgf/cm$^2$g through the fifth and sixth impellers 1*e* and 1*f* and discharged with a final temperature of 152.5° C. into the second reaction tank 6*b*. The delivery solution of 92° C. and 75 kgf/cm$^2$g from the outlet port 12 of the first pump section "A" is also directed to the pressure reduction bushing 8 disposed on the shaft 2 at a place between the two pump sections "A" and "B". Therefore, the solution having the same temperature as that discharged at the port 12 or a temperature higher than that is directed toward the intake sides of the second stage impeller 1*b* of the first pump section "A" and the third stage impeller 1*c* of the second pump section "B", respectively through the bushing 8. Accordingly, the solution having the temperature of 150° C. and the pressure of 70 kgf/cm$^2$g to be supplied from the tank 6*a* to the intake port of the second pump section "B" is effectively prevented from flowing toward the second stage impeller 1*b* of the first pump secton "A". Also, the pressure reduction bushing 10, disposed on the shaft 2 at the position intermediate the impeller 1*e* and the mechanical seal 3*b* discharges a portion of the solution having a temperature of 150° C. and pressure of 130 kgf/cm$^2$g to be sucked into the intake side of the fifth stage impeller 1*e* to the intake port of the second pump section "B" where the solution temperature is the same as or higher than 150° C. and the pressure is 70 kgf/cm$^2$g. The bushing 10 also receives the solution of 92° C. and 75 kgf/cm²g discharged from the first pump section "A" so as to prevent the leakage of the solution of 150° C. and 70 kgf/cm²g, which is to be sucked into the impeller 1*c*, toward the mechanical seal 3*b* and discharges the solution through a piping to the inlet port of the first pump section "A" where the solution temperature is 90° C. and the pressure thereof is 15 kgf/cm²g thereby making the conditions of the solution at the portion of the mechanical seal 3*b* close to those at the intake side mechanical seal 3*a*.

Thus, the mechanical seal 3*b* is not subjected to the severe conditions created by the high pressure and high temperature of the solution whereby safe sealing at the mechanical seal 3*b* is assured and, further, the designing of such seals is made relatively simple compared to those used in the prior art. The pressure reduction bushings 7 and 8 reduce the pressure of internally leaked liquid between the impeller within the same pump section. The solution is generally directed as indicated by the arrow so as to assist in moderating the sealing requirements of the system.

Figure 2B:
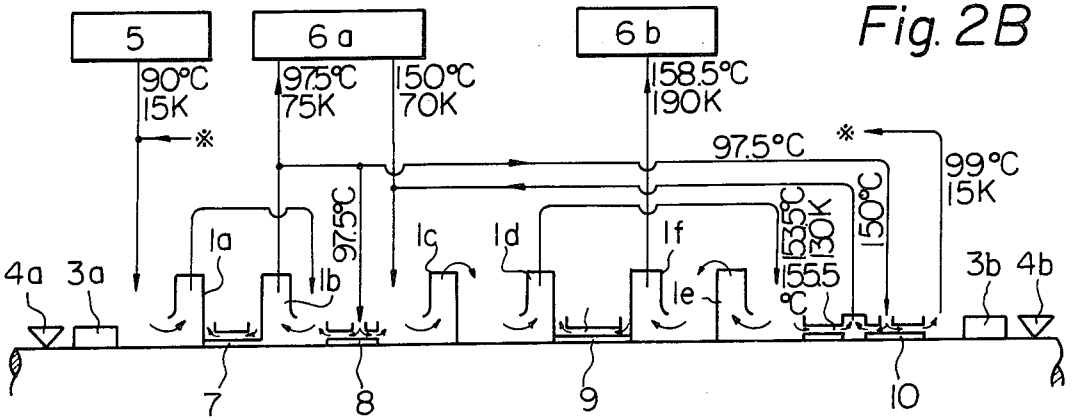

In FIG. 2B, there is illustrated a schematic drawing similar to that in FIG. 2A and this FIG. 2B represents the pressures and temperatures in the system when the multi-stage pump is operated at minimum flow rate. The most critical condition with respect to leakage is represented at the bushing 10 where it is subjected to the solution of 155.5° C. and 70 kgf/cm²g and the solution discharged from this bushing 10 is 99° C. and 16 kgf/cm²g. As explained in the foregoing, the pressurized solution of relatively low temperature from the outlet port of the first pump section "A" is directed to this bushing 10 so as to prevent the solution of high temperature from leaking in the direction toward the seal 3*b* at the bushing 10.

Figure 3A:
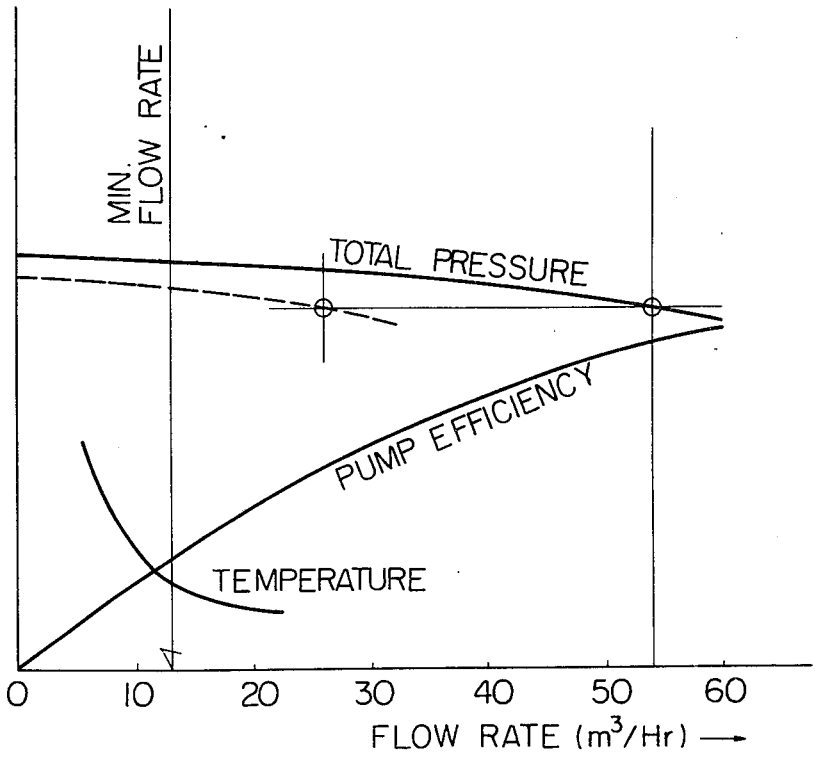
FIGS. 3A and 3B are curves showing the respective characteristic features of the two pump sections "A" and "B" involved in the pump illustrated.
Figure 3B:
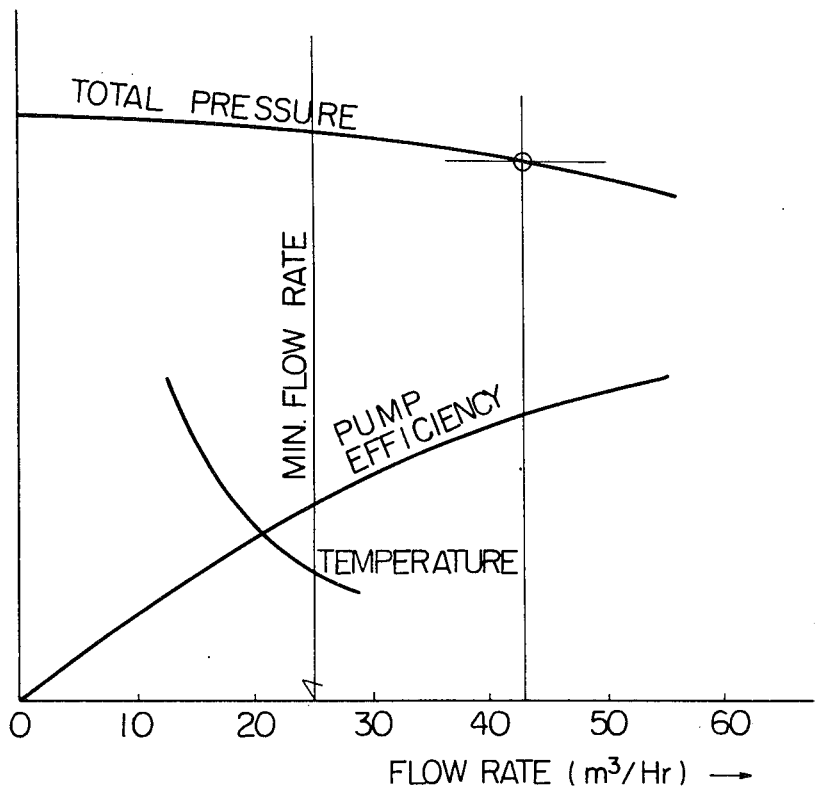

In FIGS. 3A and 3B, respective characteristic curves of the pump sections "A" and "B" are illustrated. As is readily seen from these drawings, the permissible operable range for the minimum flow rate is fairly limited in the second pump section "B" compared to that of the pump section "A" due to the fact that the temperature of the solution is higher in section "B". In FIG. 3A there is shown a dotted curve and this dotted curve indicates the actual delivery pressure which is lower than the pressure when a part of the liquid discharged is not utilized to moderate sealing condition.

Figure 4:
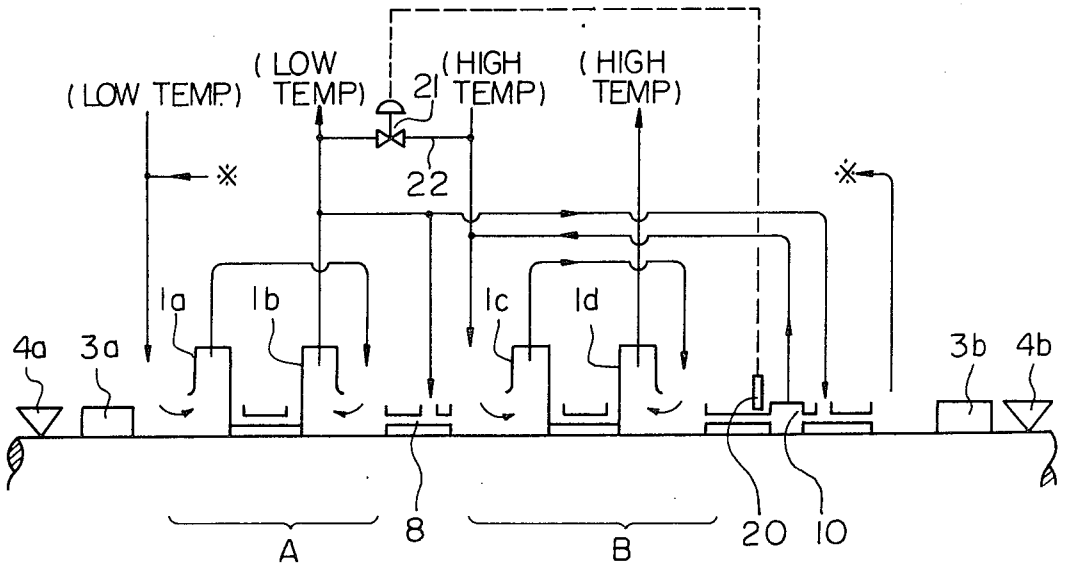
FIG. 4 is a simplified schematic illustration of the system according to this invention wherein a means for enlarging the operational range of the pump is incorporated.

In FIG. 4, there is shown a simplified schematic illustration of the sealing system similar to those shown in FIGS. 2A and 2B; however, the stages 1*e* and 1*f* are omitted in this drawing since the purpose of this illustration is to show how the operationable range for minimum flow rate is increased and stages 1*e* and 1*f* are not essential to understanding of the concept. (It is also noted in FIG. 4 that the impeller 1*d* is mounted on the shaft 2 in such a manner as to counteract the thrust of the impeller 1*c*.)

Figure 5:
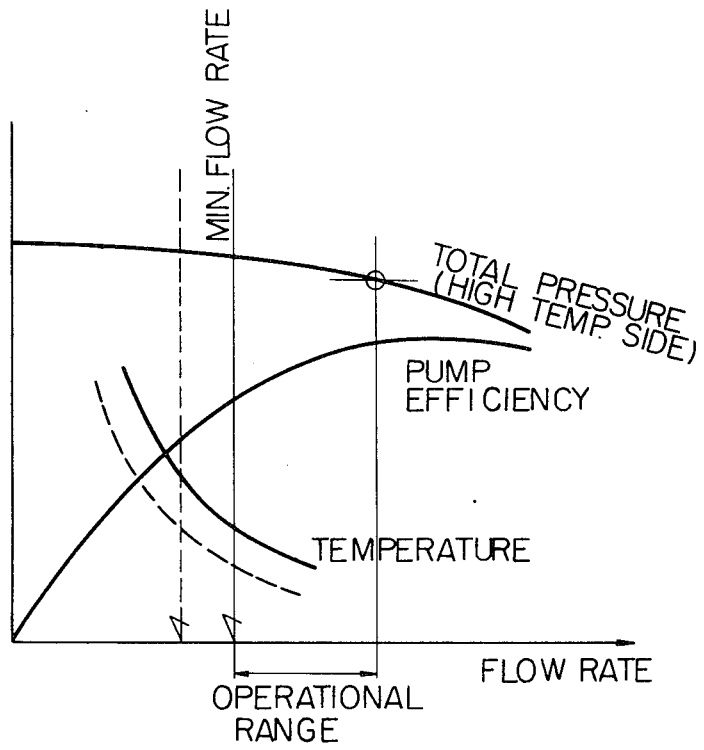
FIG. 5 is curves of the pump characteristics showing the improvement obtained by the arrangement of FIG. 4.

As explained in the embodiments shown in FIGS. 2A and 2B and curves shown in FIGS. 3A and 3B, the likelihood of leakage of the solution may be increased at the various places of the pump when the temperature and pressure of the solution are high, and this imposes difficulty in designing the mechanical seal 3*b*. Further, the solution of high temperature and high pressure in the pump section "B" may flow towards the section "A" and/or evaporate therein which makes it very difficult or, sometimes, impossible to continue further operation of the multi-stage pump. The pressurized solution of low temperature, therefore was intentionally directed to the bushings 8 and 10 in each of the illustrated systems in FIGS. 2A and 2B. This also prevents the solution of high temperature of the pump section "B" from leaking to the low temperature place and low pressure side of the other pump section "A". In the system illustrated in FIG. 4, a detector 20 is disposed adjacent the bushing 10 so as to sense the temperature of the solution at the bushing 10. If the temperature sensed by the detector 20 becomes higher than the predetermined value, the signal developed by the detector 20 is transmitted to a control valve 21 which is disposed in a line 22 connecting the discharge line of the first pump section "A" and the inlet line of the second pump section "B". The valve 21 is normally closed, and, if the signal above is received by the valve 21, the valve responds thereto and opens the passage thereof so as to introduce the solution of low temperature in the first pump section "A" into the second pump section "B" thereby lowering the temperature of the solution to be sucked into the second pump section and lower the minimum flow rate and extend the operational range of the pump. This effect is schematically shown in FIG. 5 wherein the temperature curve shown in solid line is shifted to the position shown in dotted line by opening the valve 21 whereby the minimum flow rate is lowered and the operational range of the pump is extended.

The position of the detector 20 is not limited to one such as illustrated and it may be disposed optionally, for example, at the discharge side of the pump such as the outlet port or outlet casing of the pump section "B".

In the plant where the liquid or solution to be pumped is processed, it is sometimes preferable or even mandatory not to stop the operation of the plant. In such a plant, the way generally practiced is to employ at least two pumps in parallel and operate them alternatively by switching from one to the other and make the maintenance work on the non-operating pump while the other is under operation.

Figure 6:
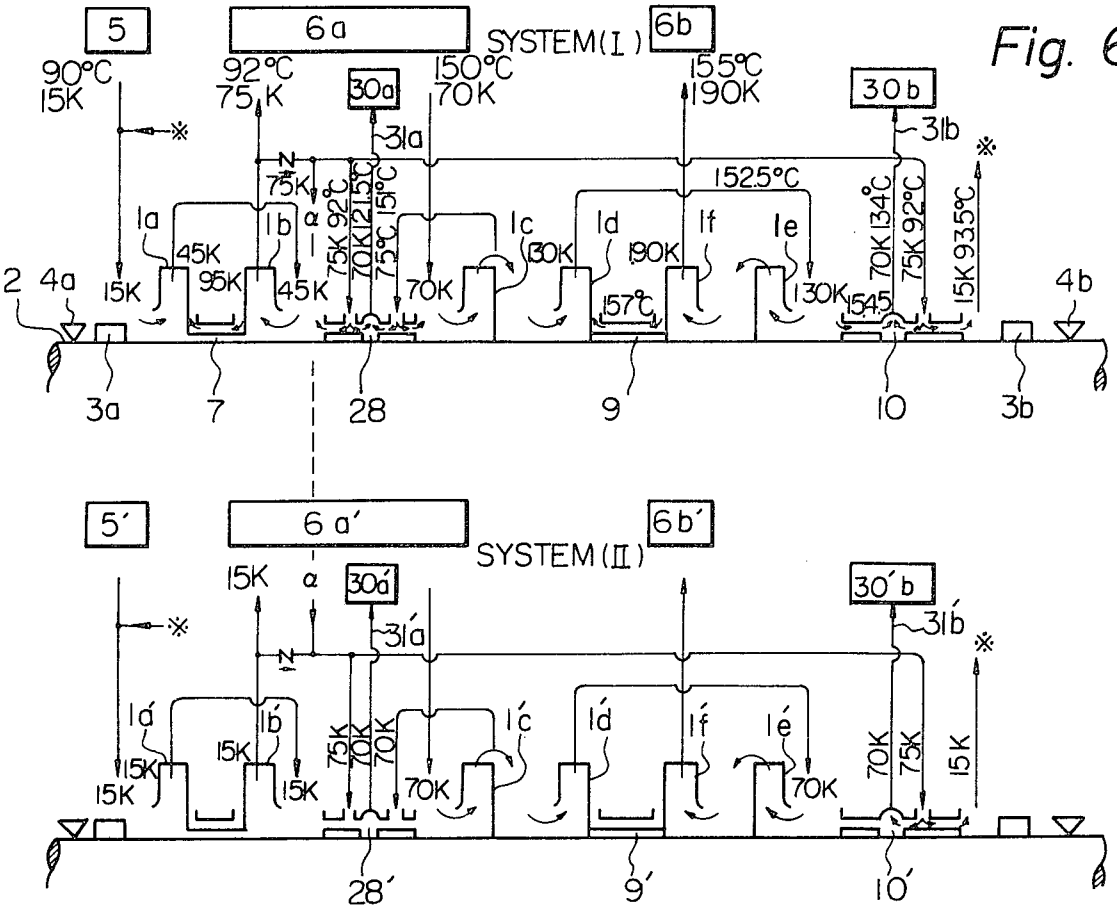
FIG. 6 schematically shows a system in which two composite multi-stage pumps are employed.

In FIG. 6, the two pump systems (I) and (II), each being similar to that of FIG. 1A, are schematically shown. The systems (I) and (II) are intended to be alternatively put in use to insure continuous operation without interruption of the plant operation. The data about the temperature and the pressure are noted in the drawing in a manner similar to the previous drawings and, therefore, no further explanation on these data is given except when it is necessary to refer to such for explaining the system in FIG. 6.

Figure 8A:
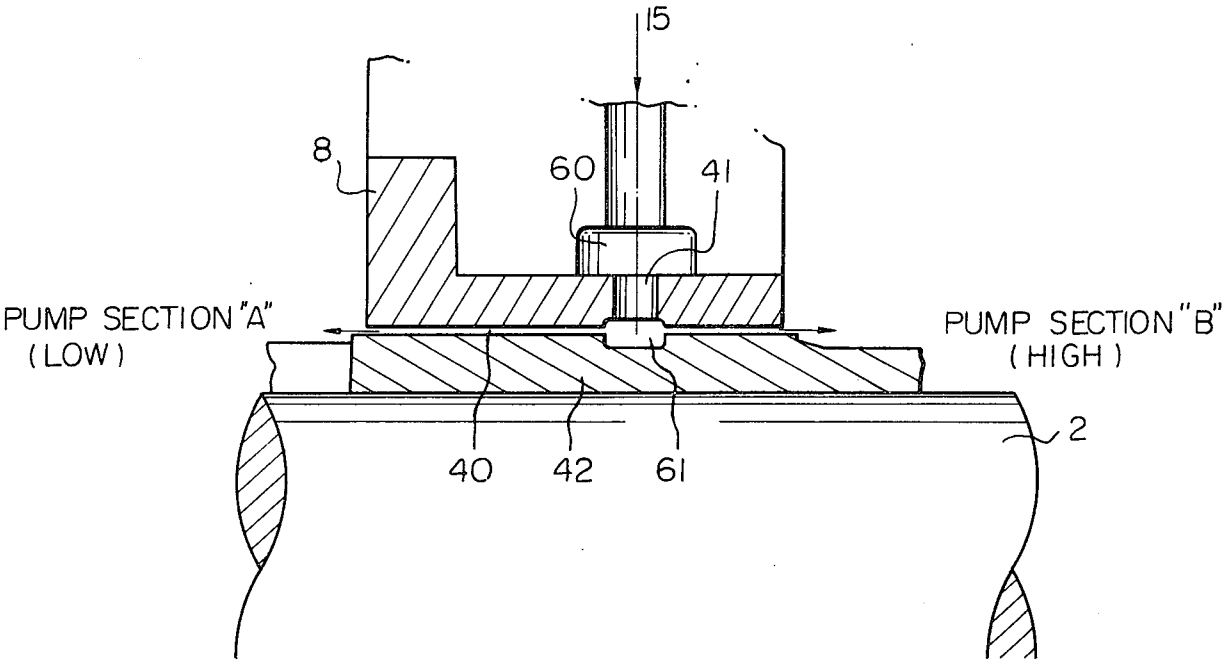
FIGS. 8A, 8B and 8C are the enlarged sectional view of the pressure reduction means employed in this invention.

It is readily noted that in system (I), there are additional reserve tanks 30*a* and 30*b* than were used in the systems already explained. The tank 30*a* is connected to the central discharge port of a pressure reduction bushing 28 by a pipe line 31*a* and the tank 30*b* is connected to the central discharge port of the bushing 10 by a pipe line 31*b*. (The detail of the bushing 28 is illustrated in FIG. 8C.) Therefore the solution discharged from the bushing 28 and having a temperature of 121.5° C. is directed to the tank 30*a* while the solution discharged from the bushing 10 and bearing a temperature of 134° C. is directed to the tank 30*b* whereby the solutions of the pump sections "A" and "B" having the different temperature, respectively will not be intermixed. The function and operation of the rest of the system (I) are substantially the same as that explained with respect to FIGS. 1 and 2A. System (II) is equivalent to the system (I), the reference numerals used therein apply to the corresponding items of system (I) with a prime, respectively. In the drawing, the system (I) is illustrated as under operation while the system (II) is illustrated while not operating. By an arrow line indicated with "α", the two systems are interconnected. As illustrated in FIG. 6, the system (II) filled with the solution having the pressure in the range of 15–70 kgf/cm²g and, thus, there is the possibility of leakage at the mechanical seals resulting unfavorable state especially in case liquid is harmful or dangerous or leakage between the two pump sections which may result in intermixing of the two solutions within the pump section "A". However, the interconnection by the arrow line "α" the solution having pressure of 75 kgf/cm²g is supplied from the system (I) whereby the pressure reduction bushings 28' and 10' of the system (II) will function satisfactorily to prevent the solution of high temperature and high pressure from leaking to the mechanical seals, especially to seal 3b' of the systems (II) wherein reserve tanks 30a' and 30b' and lines 31a' and 31b' are included which are the same in function as 30a, 30b, 31a and 31b, respectively in the system (I). While the reserve tanks 30a, 30b, 30a' and 30b' are illustrated in FIG. 6, they may be omitted and the lines 31a, 31b, 31a' and 31b' may be directly connected to the tanks 6a and 6a' so as to simplify the whole construction. Further, the reservoir 5', reaction tanks 6a' and 6b', and additional reserve tanks 30a' and 30b' in the system (II) may be omitted and those corresponding in system (I) may be also used for this system (II).

From the foregoing, it is noted that in the embodiments illustrated in FIGS. 1, 2A, 2B and 4, there is a possibility that the liquid flowing through one of the pump sections may intermix with the liquid flowing in the other pump section while they function satisfactorily. For instance, referring to FIG. 2A, part of the solution discharged from the outlet of the pump section "A" is introduced into the pressure reduction bushing 8 and, as shown by arrows, part of such solution is directed to the intake of the impeller 1c of the pump section "B" whereby the solution of the pump section "A" will intermix with the solution which has been processed through the tank 6a. Contrary, in the embodiment shown in FIG. 6, it is devised to prevent such intermixing of the different solutions. The resultant mixed solution at a pressure reduction bushing 28 is discharged from the pumping system either into the reserve tank 30a or the tank 6a. Also, at the pressure reduction bushing 10 in FIGS. 1, 2A and 2B, the solution discharged from the pump section "A" is directed thereto and part of this solution and part of the solution sucked into the intake of the impeller 1e of the pump section "B" are mixed and fed back together to the intake of the pump section "B" thereby causing mixing of the two different solutions. However, at the pressure reduction bushing 10 in FIG. 6, the mixed solution is directed out of the pumping system and directed into either the reserve tank 30b or the tank 6a thereby preventing the possibility of the intermixing within the pump sections from occurring.

Figure 7:
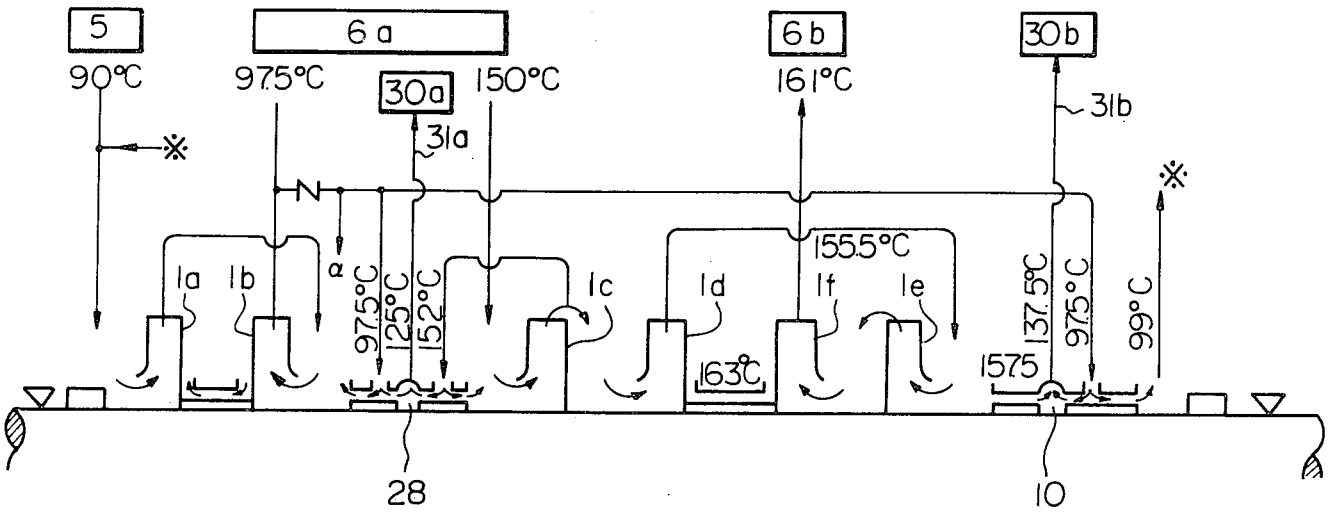
FIG. 7 is an illustration similar to those in FIGS. 1A and 1B with the data for the minimum flow rate.

In FIG. 7, the condition regarding the temperatures at several place is indicated which corresponds to those under the operation at minimum flow rate. Since the pressures are the same as those in the system (I) in FIG. 6 showing the data under the normal or nominal operation, they are omitted from FIG. 7.

Now the pressure reduction bushings 8, 10 and 28 will be described. In FIG. 8A, the pressure reduction bushing 8 is illustrated with associated portions. The bushing 8 is stationarily installed in the housing of the pump so as to provide a restricted flow passage 40 between a sleeve 42 mounted on the shaft and the bushing 8. At a place between the axially opposite ends of the bushing 8, an injection passage 41 is provided which is adapted to receive solution pressurized by the impeller 1b of the pump section "A". The passage 41 may be a single hole or a plurality of holes circumferentially disposed so as to communicate with the flow passage 15 through circumferential grooves 60 and 61. The purpose of this bushing is, as already touched upon earlier, to isolate the solution in the pump section "A" under relatively lower pressure and lower temperature compared to those of the pump section "B" from the solution in the pump section "B" so as to prevent the intermixing of the solutions of "A" and "B" otherwise unfavorable vaporization or evaporation may occur in the pump section especially one under lower temperature and lower pressure. Referring to FIG. 2A, the pump section "A" is under the pressure of 45 kgf/cm²g at the left hand end of the restricted flow passage 40 and the pump section "B" is under the pressure of 70 kgf/cm²g and the temperature of 150° C. at the right hand end of the passage 40. Therefore, if the solution under 75 kgf/cm²g and at 92° C. is injected into the hole 41 through the passage 15, the injected solution will overcome the pressures at the both ends of the bushing and flow in the opposite axial directions as indicated by the arrows thereby effectively preventing the intermixing of the solutions of "A" and "B" sections.

Figure 8B:
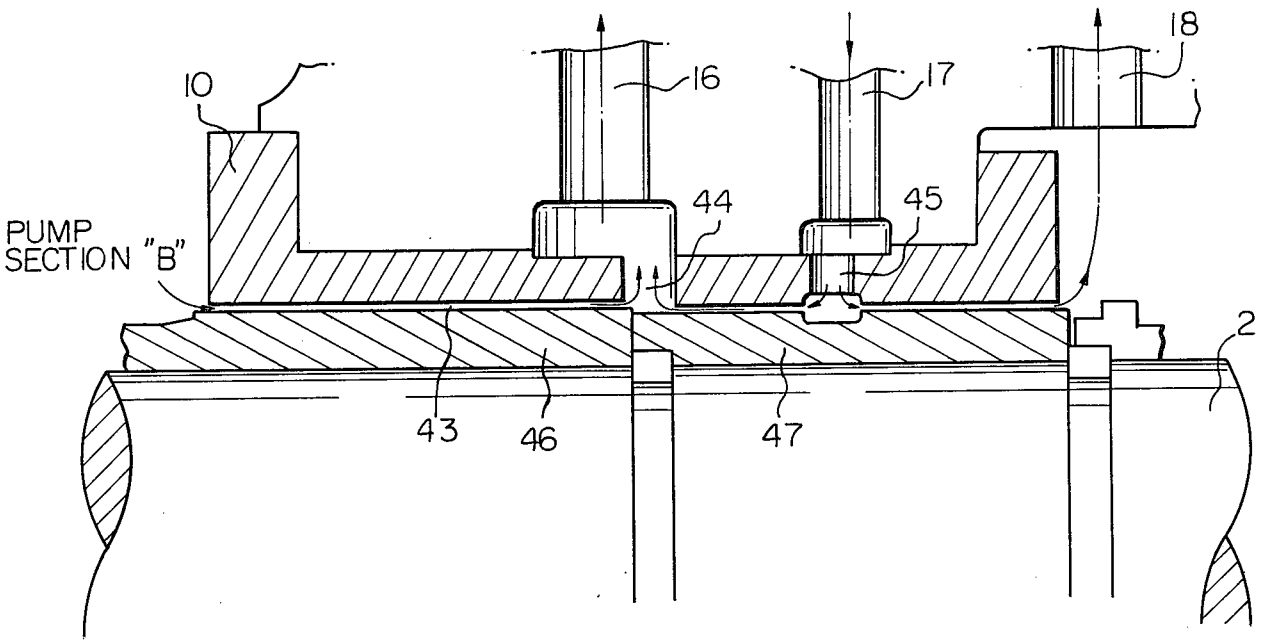
Figure 8C:
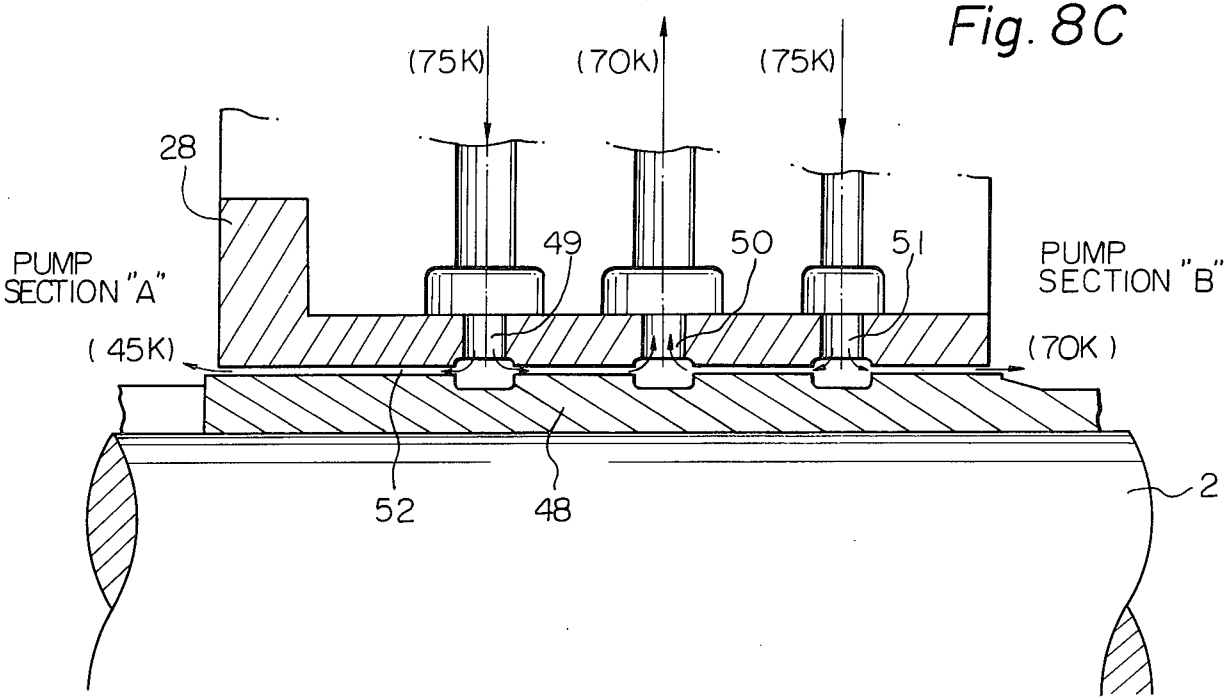

In FIG. 8B, the pressure reduction bushing 10 is illustrated with cooperating portions of the pump. Similar to that shown in FIG. 8A, a restricted flow passage 43 is provided between the inner cylindrical surface of the stationary bushing 10 installed in the pump casing and sleeves 46 and 47 fitted on the shaft 2. At two places between the opposite axial ends of the bushing, two holes or radial flow passages 44 and 45 go through the wall of the bushing 10 which communicates with the passages 16 and 17, respectively. Also, the right hand end of the restricted flow passage 43 communicates with the passage 18. If the data shown in FIG. 2A is referred to here again, the solution under 75 kgf/cm²g and 92° C. is injected into the narrow passage 43 through the passage 17 and the hole 45. Since the solution within the pump section "B" adjacent the left hand end of the passage 43 is under 130 kgf/cm²g and at 150° C., the flow of the solution will become as illustrated by arrows in the drawing. The bushing 10 is explained as one-piece; however it may be constructed by two bushings with a gap corresponding to the hole 44 therebetween. It is noted that the bushing 10 is applicable to all the embodiments while the bushing 8 is not applicable to the embodiment in FIGS. 6 and 7.

The bushing 28 useful in the embodiment in FIGS. 6 and 7 is illustrated in FIG. 8C. The bushing 28 is stationarily installed in the pump casing while maintaining a restricted axial flow passage 52 between a sleeve 48 and the bushing 28 mounted on the shaft 2. For the convenience, relative data regarding the pressures picked up from FIG. 6 are given in the respective parenthesis. According to the relationship between the pressures indicated, the flow of the solution will become as indicated by the arrows. As explained earlier, the arrangement shown effectively prevents intermixing of solutions of "A" and "B" sections within the pump sections.

In FIGS. 8B and 8C, the radial passages 44, 45, 49, 50 and 51 may be accompanied with circumferential grooves similar to grooves 60 and 61 in FIG. 8A, respectively.

Although in all the foregoing embodiments an even number of impellers are illustrated in each group, such condition is not mandatory and an odd number of impellers may be employed in each group provided that the resultant thrust is arranged to be the minimum or zero.

As detailedly explained above, the sealing system of this invention provides such advantageous features as simplifying the design and manufacture of the sealing mechanism, balancing the axial thrust of the shaft over a wide range of operational conditions and assuring the safe and stable operation of the pump(s) which is kept substantially free from leakage and evaporation of the high temperature and high pressure solution which might be harmful sometime.

In the foregoing explanation, the multi-stage pump has been explained as four-staged, or six-staged and comprising two sections "A" and "B"; however, the foregoing stages and pump sections are merely explanatory and the invention is not limited to those illustrated or explained.

The invention has been explained in detail referring to the embodiments but it should be noted that the modification and variation are readily available to those skilled in the art with the spirit and scope of this invention.

We claim:

1. A sealing system for use in a composite multistage pump wherein a plurality of impellers are serially and securely mounted on a shaft so as to form at least two pump sections, the temperature of the liquid passing through the pump sections being raised sequentially at each of said pump sections, said sealing system comprising:

sealing means disposed at the opposite end portions of the shaft where said shaft extends through the pump casing;

pressure reduction means disposed around said shaft at a place between the last pump section and one of said sealing means;

a pipe line coupling the outlet port of the first pump section with the inlet port of the last pump section;

temperature detector means for sensing the temperature of liquid flowing through the last pump section; and a control valve disposed in said pipe line and operated in response to the temperature sensed by said temperature detector means.

2. A sealing system as claimed in claim 1 wherein said control valve is normally closed and is opened when the temperature detector means senses that the temperature is beyond a predetermined value.

3. A sealing system for use in a composite multistage pump wherein a plurality of impellers are serially and securely mounted on a shaft so as to form at least two pump sections each having an outlet port and an inlet port, said sealing system comprising:

sealing means disposed at the opposite end portions of the shaft where said shaft extends through the pump casing; and a pressure reduction bushing disposed around said shaft at a place between the last pump section and one of said sealing means to provide a restricted axial flow passage between the shaft and said bushing, said bushing provided in the wall thereof with two radial passages axially disposed such that one of said radial passages introduces pressurized liquid into said restricted axial flow passage and the other passage discharges the liquid from said axial flow passage;

whereby intermixing of said liquid passing through said at least two pump sections is prevented.

4. A sealing system as claimed in claim 3 wherein said pressurized liquid introduced into said restricted flow passage is supplied from the outlet port of one of the pump sections serially preceding the last pump section.

5. A sealing system as claimed in claim 3 further comprising: an intermediate pressure reduction bushing disposed around the shaft at each intermediate place between the pump sections, each of said intermediate bushings providing a restricted axial flow passage between the shaft and said intermediate bushing and being provided with a radial flow passage in the wall thereof at the intermediate place between the axially opposite ends thereof, and each intermediate bushing introducing pressurized liquid into said restricted flow passage at said intermediate bushing from the outlet of one of the pump sections serially preceding the last pump section.

6. A system as claimed in claim 5 wherein said system is applied to at least two composite multi-stage pumps as defined, the system comprising a pipe line disposed between the respective flow passages of the two pumps so as to transmit the pressurized liquid from one to the other and vice-versa, said pipe line being connected to each of the pumps at the place where said liquid discharged from said preceding pump section flows, said intermediate bushing being provided with additional two radial flow passages in the wall thereof making the number of total passages three arranged in axial direction each communicating with said restricted flow passages, liquid under pressure being introduced into the two holes each being located adjacent the axially opposite ends of said bushing and part of the liquid introduced from said two passages being discharged outside of said system through the remaining one passage between said two passages, the liquid discharged from the restricted passage of said last burning being also discharged outwardly from the system.

7. A system as claimed in claim 4 wherein a tank is disposed between the outlet port of the preceding pump section and the inlet port of the next pump section so that the liquid discharged from said outlet port is introduced into said tank and thence fed to said intake port.

8. A system as claimed in claim 7 wherein the other of said radial passages directs the liquid discharged therefrom to said tank.

9. A system as claimed in claim 8 wherein the bushing is a first bushing and an additional pressure reduction bushing is disposed around the shaft at each intermediate place between the pump sections so as to provide a restricted axial flow passage between the shaft and said intermediate additional bushing, said additional pressure reduction bushing provided with a radial flow passage in the wall thereof at the intermediate place between the axially opposite ends thereof such that pressurized liquid is introduced into said restricted flow passage, the liquid passed through said restricted passage in said first bushing in the direction toward the sealing means adjacent said bushing being directed to the intake port of the serially first pump section.

* * * * *